US005772068A

United States Patent [19]

Hailey

[11] Patent Number: 5,772,068

[45] Date of Patent: Jun. 30, 1998

[54] AEROSOL EXTENSION SPRAY TUBE HOLDER

[76] Inventor: Elizabeth P. Hailey, 3345 Gatewood Dr., Memphis, Tenn. 38134

[21] Appl. No.: 934,702

[22] Filed: Sep. 22, 1997

[51] Int. Cl.[6] ..... A47G 1/10; B65D 21/00

[52] U.S. Cl. ..... 220/735; 220/710; 278/311.2

[58] Field of Search ..... 220/735, 710; 248/311.2

[56] References Cited

U.S. PATENT DOCUMENTS

| | | | |
|---|---|---|---|
| 5,150,811 | 9/1992 | Kelston | 220/710 X |
| 5,178,354 | 1/1993 | Engvall | 248/316.7 |
| 5,275,304 | 1/1994 | Abrams | 220/710 X |
| 5,460,264 | 10/1995 | Rupert | 220/710 X |
| 5,482,095 | 1/1996 | de Chollet | 141/380 |
| 5,558,247 | 9/1996 | Caso | 220/735 |
| 5,722,561 | 3/1998 | Biondich et al. | 220/710 |

*Primary Examiner*—Steven M. Pollard
*Attorney, Agent, or Firm*—Walker, McKenzie & Walker, P.C.

[57] ABSTRACT

An extension spray tube holder secured to the outside surface of an aerosol spray can. The contents of the can are under pressure and are delivered through a very small orifice in a nozzle atop the can, with a valve being interposed between the nozzle and the pressurized interior of the can. The valve may be operated by manually depressing the top of the nozzle assembly, so as to cause the contents of the can to spray from the nozzle in a conical spray pattern that broadcasts the sprayed contents onto a workpiece. The tube holder is generally cylindrical and has upper and lower ends and a bore extending longitudinally through at least a portion of the tube holder. The bore has an upwardly-opening mouth proximate the upper end of the spray tube holder, and the bore further has a constricted portion adapted for frictionally retaining the spray tube when the spray tube is inserted through the mouth of the spray tube holder and into the bore. The tube holder is preferably pinchingly deformed, either at a midportion or at a bottom portion of the tube holder, so as to form the constricted portion of the bore. The lower end of the tube holder may be closed.

4 Claims, 2 Drawing Sheets

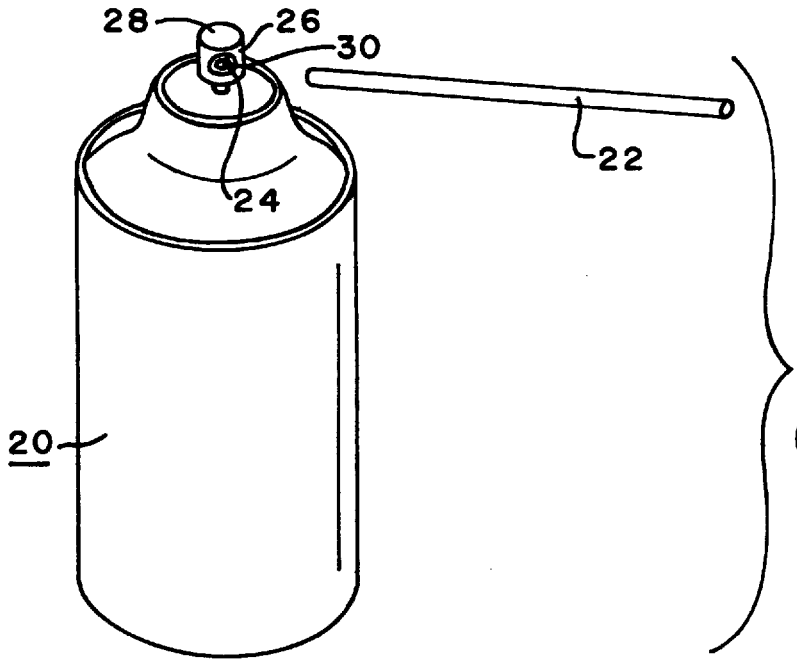
FIG. 1
(Prior Art)
FIG. 2
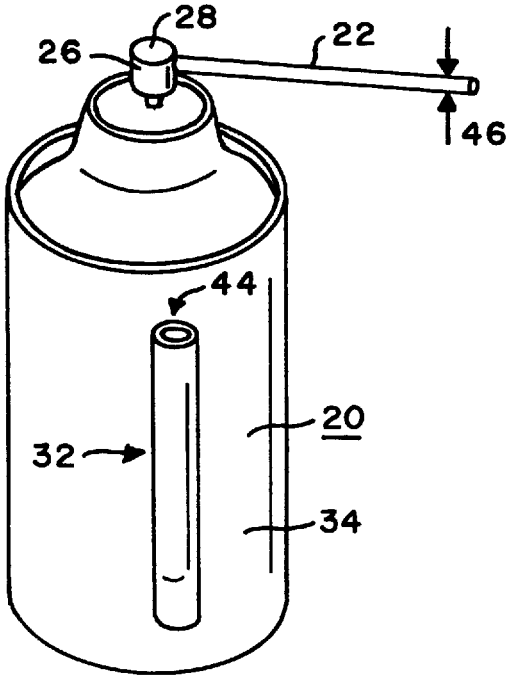
FIG. 3
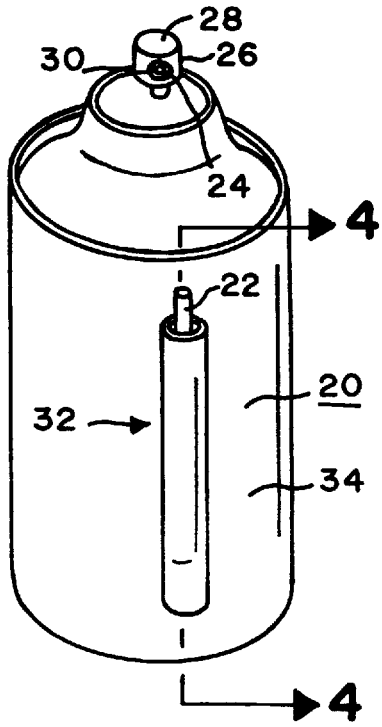

AEROSOL EXTENSION SPRAY TUBE HOLDER

BACKGROUND OF THE INVENTION

1. Field of the Invention: The present invention relates, in general, to extension tube holders, and in particular, to extension tube holders for use with aerosol cans.

2. Information Disclosure Statement: Aerosol spray cans, containing solvents, lubricants, and the like, are in common use. In a typical case, the contents of the can are under pressure and are delivered through a very small orifice in a nozzle atop the can, with a valve being interposed between the nozzle and the pressurized interior of the can. Typically, the valve is operated by manually depressing the top of the nozzle assembly, so as to cause the contents of the can to spray from the nozzle in a conical spray pattern that broadcasts the sprayed contents onto a workpiece.

Often this broad conical spray pattern is undesirable for delivery of the can's contents into a restricted or relatively inaccessible area, and it is well known to provide an extension tube, for being press-fittingly received into a tube-receiving bore that is concentric with the spray orifice and into the nozzle, so as to allow the contents of the can to travel from the spray orifice, through the extension tube, and out the distal end of the spray tube remote from the spray orifice. The extension tube is typically a flexible plastic tube about three or four inches (7.6 to 10.2 cm.) in length, typically having an outer diameter of about 2 mm and having an inner diameter of about 0.7 mm. By inserting the distal end of the spray tube into the relatively inaccessible area while the proximal end of the spray tube is received into the tube-receiving bore in the nozzle, the contents of the can are able to be efficiently and easily delivered into that previouslyinaccessible area without spraying the contents onto an adjacent area of the workpiece.

There is, however, a well-known problem in the prior art with shipping the spray tube together with the aerosol can to a retail store, affixing the spray tube to the aerosol can during and after the sale of the can to a customer, and storing the extension spray tube with the can between uses of the spray can by the customer. Because the spray tube extension is only used for certain applications, it is not practical or desirable to permanently affix the spray tube extension to the aerosol nozzle assembly, and, for this reason, the spray tube extension is only press-fittingly received into the nozzle assembly for those certain uses of the aerosol spray can that require such an extension.

Well-known prior art solutions to the problem of affixing the spray tube extension to the aerosol can include the use of well-known cellophane tape to affix the tube to the surface of the can and the use of a well-known rubber band around the circumference of the can to entrappingly retain the spray tube to the can. The use of cellophane tape is problematical because the tape deteriorates over time and the adhesive backing on the tape becomes ineffective with repeated removal and reapplication of the tape over the spray tube. The use of a rubber band to hold the spray tube to the aerosol can is also unsatisfactory because the rubber often deteriorates, causing the rubber band to break or lose its elasticity. With any of these prior art solutions for holding the spray tube, the tube frequently becomes lost before or after purchase of the aerosol can and spray tube combination.

It is therefore desirable to have a spray tube holder for affixing the spray tube to the exterior surface of an aerosol can in such a manner that the spray tube is easily removed for use and easily replaced into the holder so as not to become lost between uses. It is further desirable that the spray tube holder not be complex or expensive because the holder will typically be discarded with the aerosol can when the can becomes empty.

A preliminary patentability search in Class 248, subclass 316.7, and Class 220, subclass 735, produced the following patents, some of which may be relevant to the present invention: Engvall, U.S. Pat. No. 5,178,354, issued Jan. 12, 1993; de Chollet, U.S. Pat. No. 5,482,095, issued Jan. 9, 1996; and Caso, U.S. Pat. No. 5,558,247, issued Sep. 24, 1996. None of these references, either singly or in combination, disclose or suggest the present invention.

BRIEF SUMMARY OF THE INVENTION

The present invention is an extension spray tube holder for an aerosol spray can, with the tube holder being secured to the outside surface of an aerosol spray can. The tube holder is generally cylindrical and has upper and lower ends and a bore extending longitudinally through at least a portion of the tube holder. The bore has an upwardly-opening mouth proximate the upper end of the spray tube holder, and the bore further has a constricted portion adapted for frictionally retaining the spray tube when the spray tube is inserted through the mouth of the spray tube holder and into the bore. The tube holder is preferably pinchingly deformed, either at a midportion or at a bottom portion of the tube holder, so as to form the constricted portion of the bore. Preferably, the lower end of the tube holder is closed.

It is an object of the present invention to provide an improved spray tube holder for retaining an extension spray tube for an aerosol can's nozzle. It is a further object of the present invention to provide a spray tube holder that allows easy removal and replacement of an extension spray tube therewithin, and that is inexpensive to produce.

BRIEF DESCRIPTION OF THE SEVERAL VIEWS OF THE DRAWING

FIG. 1 is a perspective view of the prior art showing an aerosol can with a well-known extension spray tube.

FIG. 2 is a perspective view of the spray tube holder of the present invention affixed to the exterior surface of an aerosol spray can.

FIG. 3 is a perspective view of the spray tube holder of the present invention affixed to the exterior surface of an aerosol spray can and with an extension spray tube received within the spray tube holder.

DETAILED DESCRIPTION OF THE INVENTION

Figure 4:
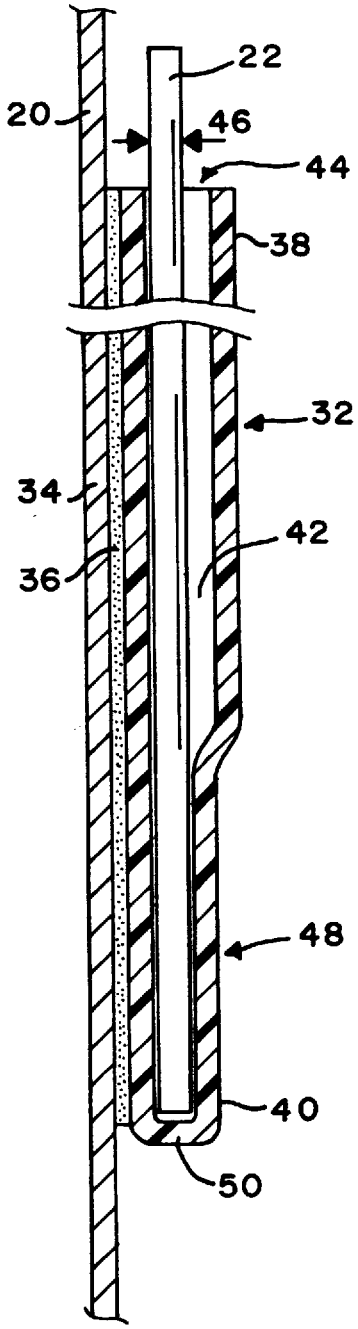
FIG. 4 is a side sectional view of a first embodiment of the present invention, showing a spray tube received therewithin and with dimensions exaggerated for purposes of illustration.

FIG. 1 shows a perspective view of a well-known prior art aerosol can or container 20 with a well-known extension spray tube 22. Such aerosol spray cans, containing solvents, lubricants (such as lubricants sold under the trademark WD-40), and the like, are in common use, with the contents of the can being under pressure for delivery through a very small orifice 24 in a nozzle 26 atop the can 20. A well-known valve, not shown, is interposed between the nozzle 26 and the pressurized interior of the can 20, with nozzle 26 thus being in selective communication with the pressurized interior of can 20 in a manner well-known to those skilled in the art, and the valve is typically operated by downwardly pressing the top 28 of the nozzle 26, thereby allowing the pressurized contents of the can 20 to sprayingly emerge from orifice 24. Nozzle 26 has a well-known enlarged tube-receiving bore 30 concentric with orifice 24 and adapted for close-fitting receipt of one end of spray tube 22 so as to allow spray tube 22 to be an extension of nozzle 26.

Referring to FIGS. 2–4, the first embodiment of the spray tube holder 32 of the present invention is shown affixed to the outside surface 34 of can 20 by affixing means such as well-known adhesive or glue 36 or double-sided tape, or other well-known equivalent means for adhering one object to another.

Tube holder 32 is generally cylindrical and has upper and lower ends 38, 40 and a generally axial bore 42 extending longitudinally through at least a portion of tube holder 32, with bore 42 having an upwardly-opening mouth 44 proximate upper end 38 of tube holder 32 and with bore 42 and mouth 44 being somewhat larger in diameter, preferably about 1.5 times to about 3 times larger, than the outer diameter 46 of spray tube 22 so as to allow easy insertion and removal of spray tube 22 into and from bore 42. Bore 42 has a constricted portion 48 adapted for frictionally retaining spray tube 22 within bore 42 when spray tube 22 is inserted through mouth 44 and into bore 42. Preferably, tube holder 32 is formed of plastic, and constricted portion 48 is preferably formed by pinchingly deforming tube holder 32 while heating the tube holder 32 so as to cause the inner dimension of constricted portion 48 to be slightly smaller than the outer diameter 46 of spray tube 22, thereby causing spray tube 22 to be frictionally retained within tube holder 32 when spray tube 22 is inserted into bore 42 and through constricted portion 48 so as to slightly deformably enlarge constricted portion 48 as tube 22 is frictionally held therewithin. Alternatively, tube holder 32 could instead be moldedly formed with constricted portion 48 being formed by a suitable mold in the same formation step as tube holder 32. Spray tube 22 is thus able to be frictionally held within spray tube holder 32 and will not inadvertently fall out when can 20 is tipped over or inverted from its normal upright orientation.

Preferably, the lower end 40 of tube holder 32 is closed as by having a sealed bottom 50 closing the bore 42 at lower end 40 so as to limit the insertion of spray tube 22 into tube holder 32.

Figure 5:
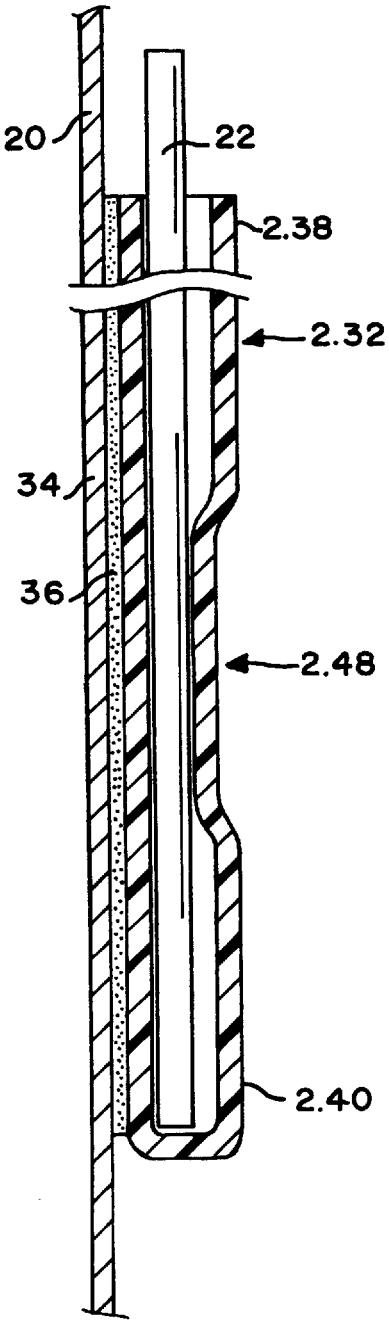
FIG. 5 is a side sectional view of a second embodiment of the present invention, showing a spray tube received therewithin and with dimensions exaggerated for purposes of illustration.

A second preferred embodiment is shown in a side sectional view in FIG. 5. Identifying reference designators for this second embodiment are marked similarly to the first embodiment, except with the prefix "2.". It shall be understood that many aspects of the two embodiments are substantially the same, and only the differences will be treated in detail, it being understood that similar structural features of the two embodiments perform similar functions.

The only substantial difference between the second preferred embodiment 2.32 and the first preferred embodiment 32 is that, in the second preferred embodiment 2.32, the constricted portion 2.48 is located within a portion of tube holder 2.32 intermediate upper and lower ends 2.38 and 2.40 rather than having the constricted portion being adjacent the lower end as shown in FIG. 4 for the first preferred embodiment.

Although the present invention has been described and illustrated with respect to a preferred embodiment and a preferred use therefor, it is not to be so limited since modifications and changes can be made therein which are within the full intended scope of the invention.

I claim:

1. In combination:

(a) a container including a nozzle and having an outside surface and an interior with contents under pressure therewithin, said nozzle being in selective communication with said pressurized interior;

(b) an elongated spray tube adapted for communicating with said nozzle; and, (c) a tube holder being secured to said outside surface of said container, said tube holder being generally cylindrical and having upper and lower ends and further having a bore extending longitudinally through at least a portion of said tube holder, said bore of said tube holder having an upwardly-opening mouth proximate said upper end of said tube holder; said bore of said tube holder having a constricted portion adapted for frictionally retaining said spray tube within said bore of said tube holder when said spray tube is inserted through said mouth of said tube holder and into said bore of said tube holder.

2. The combination as recited in claim 1, in which said lower end of said tube holder is closed.

3. The combination as recited in claim 1, in which said tube holder is pinchingly deformed so as to form said constricted portion of said bore of said tube holder.

4. The combination as recited in claim 1, in which said tube holder is pinchingly deformed so as to form said constricted portion of said bore of said tube holder and said lower end of said tube holder is closed.

* * * * *